US012134892B2

(12) United States Patent
Ghet

(10) Patent No.: US 12,134,892 B2
(45) Date of Patent: Nov. 5, 2024

(54) MODULAR STRUCTURAL SYSTEM AND CONSTRUCTION METHOD THEREOF

(71) Applicant: Abd Elaziz Ghet, Jerusalem (IL)

(72) Inventor: Azam Ghet, Jerusalem (IL)

( * ) Notice: Subject to any disclaimer, the term of this patent is extended or adjusted under 35 U.S.C. 154(b) by 0 days.

(21) Appl. No.: 17/614,358

(22) PCT Filed: Jun. 25, 2020

(86) PCT No.: PCT/IL2020/050710

§ 371 (c)(1),
(2) Date: Nov. 25, 2021

(87) PCT Pub. No.: WO2020/261274

PCT Pub. Date: Dec. 30, 2020

(65) Prior Publication Data

US 2022/0220733 A1 Jul. 14, 2022

Related U.S. Application Data

(60) Provisional application No. 62/865,999, filed on Jun. 25, 2019.

(51) Int. Cl.
*E04B 2/86* (2006.01)
*E04B 1/16* (2006.01)

(52) U.S. Cl.
CPC ..... *E04B 2/8635* (2013.01); *E04B 1/167* (2013.01); *E04B 2002/867* (2013.01)

(58) Field of Classification Search
CPC .. E04B 2/8635; E04B 1/167; E04B 2002/867; E04B 2/8652; E04B 2/86
See application file for complete search history.

(56) References Cited

U.S. PATENT DOCUMENTS

| | | | | |
|---|---|---|---|---|
| 6,321,497 | B1 * | 11/2001 | Cormier | E04C 1/40 52/565 |
| 10,604,906 | B2 * | 3/2020 | Foley | E02D 17/08 |
| 2007/0094973 | A1 * | 5/2007 | Zhu | E04B 1/161 52/415 |
| 2008/0005991 | A1 | 1/2008 | Meilleur et al. | |
| 2016/0340899 | A1 * | 11/2016 | Piccone | E04B 2/86 |
| 2017/0107715 | A1 | 4/2017 | Meilleur et al. | |

FOREIGN PATENT DOCUMENTS

| | | | | |
|---|---|---|---|---|
| EP | 2927383 | A1 * | 10/2015 | E04B 2/8635 |
| FR | 3 008 116 | | 1/2015 | |
| IL | 248112 | | 3/2017 | |
| WO | WO-2006081689 | A1 * | 8/2006 | E04B 2/8635 |

* cited by examiner

*Primary Examiner* — Brian D Mattei
*Assistant Examiner* — Omar F Hijaz
(74) *Attorney, Agent, or Firm* — The Law Office of Joseph L. Felber

(57) ABSTRACT

A modular structural system, comprising one or more building units consisting of two counter mold partitions, each of which is adapted with one or more anchoring means, into which one or more connecting locks are engaged to firmly lock and stabilize the two counter mold partitions, where each of the two counter mold partitions is peripherally adapted to receive one or more affixing coupling means; two or more coupling means for affixing two of the one or more building units; two or more coupling means for affixing the one or more building units to an adjacent building element.

16 Claims, 8 Drawing Sheets

MODULAR STRUCTURAL SYSTEM AND CONSTRUCTION METHOD THEREOF

FIELD OF THE INVENTION

The present invention is in the fields of concrete structures construction. More specifically, the invention relates to a modular structural system and construction method thereof, which is utilized for efficient construction of various structures in an economical modular manner.

BACKGROUND OF THE INVENTION

Current construction methods aim to industrialize the construction process, using frames, advanced techniques and materials for constructing large structures.

However, none of these methods has yet solved crucial problems of the construction industry, such as structure failure, disengagement of reinforcement frames from molded structural elements, disintegration and cracking, and loss of workers lives during the construction process.

Many of the above failures and risks are due to the numerous manual tasks being performed in inconvenient postures at heights (e.g., pre-casting preparations for concrete structures including molds and reinforcement mesh installation, and post-casting tasks such as uninstalling molds).

The costs of construction are currently also still high because of the heavy workload and equipment, which are required and the significant amount of time for completing a construction from the foundation to the finish.

It is therefore an object of the present invention, to provide a modular structural system of pre-made elements and coupling means that structurally integrate with the casted concrete structure thereby do not require post-casting disassembly and reducing the pre-casting preparations.

It is another object of the present invention, to provide a modular structural system and construction method thereof, which enables simple and modular construction of extended structural elements, thereby enabling reduced construction time.

Other objects and advantages of the invention will become apparent as the description proceeds.

SUMMARY OF THE INVENTION

The invention relates to a modular structural system, comprising: a) one or more building units being comprised of two counter mold partitions, each of which is adapted with one or more anchoring means, into which one or more connecting locks (i.e., which may be of an adjustable length) are engaged to firmly lock and stabilize the two counter mold partitions, wherein each of the two counter mold partitions is peripherally adapted to receive one or more affixing coupling means, b) two or more coupling means for affixing two of the one or more building units, and c) two or more coupling means for affixing the one or more building units to an adjacent building element.

The two or more mold partitions are selected from the group consisting of: a solid plate, a multilayered plate (e.g., comprising a thermal isolation layer), or any combination thereof.

According to one embodiment of the present invention, the one or more anchoring means are added onto the two or more mold partitions. According to another embodiment of the invention the one or more anchoring means are integrated within the two or more mold partitions.

According to an embodiment of the present invention, the one or more anchoring means is integrated with the two or more coupling means.

The invention further relates to a modular construction method, comprising: a) providing one or more building units being comprised of two counter mold partitions, being connected by connecting locks, b) affixing each two residing building units by two or more coupling means, c) affixing building units to an adjacent building element, by two or more coupling means, and d) casting a solidifying substance into the one or more building units.

According to an embodiment of the present invention, the utility elements are embedded within one or more of the two counter mold partitions before casting a solidifying substance into the one or more building units.

According to an embodiment of the present invention, one or more adjustable connecting locks are provided to enable modifying the depth of the one or more building units before casting the solidifying substance into the one or more building units.

The solidifying substance may be prepared from a mixture of at least two of the following materials:

White cement;
Black cement;
Sea sand;
Quartz sand;
Fiberglass fibres;
Fiberglass rods construction;
Power and fibres of basalt;
Mineral wool;
Sodium-Chloride power.

DETAILED DESCRIPTION OF THE DRAWINGS

The present invention relates to a modular structural system, comprising multilayered building units of multiple different types, being engaged to form building elements (e.g., construction wall, gravity wall, piling wall, cantilever wall, anchored wall, staircase, internal walls, etc.) in a fast and modular manner, where each building unit is constructed of two counter partitions being firmly connected by suitable connecting locks, thus forming a mold into which solidifying substance such as concrete is casted. The proposed system further comprises suitable coupling means as well as adhesive materials for affixing two residing building units, or for affixing building units to adjacent building element such as to the floor.

In the following detailed description, references are made to the accompanying drawings that form a part hereof, and in which are shown by way of illustrating specific embodiments or examples. These embodiments may be combined, other embodiments may be utilized, and other changes may be made without departing from the spirit or scope of the present invention.

Figure 1:
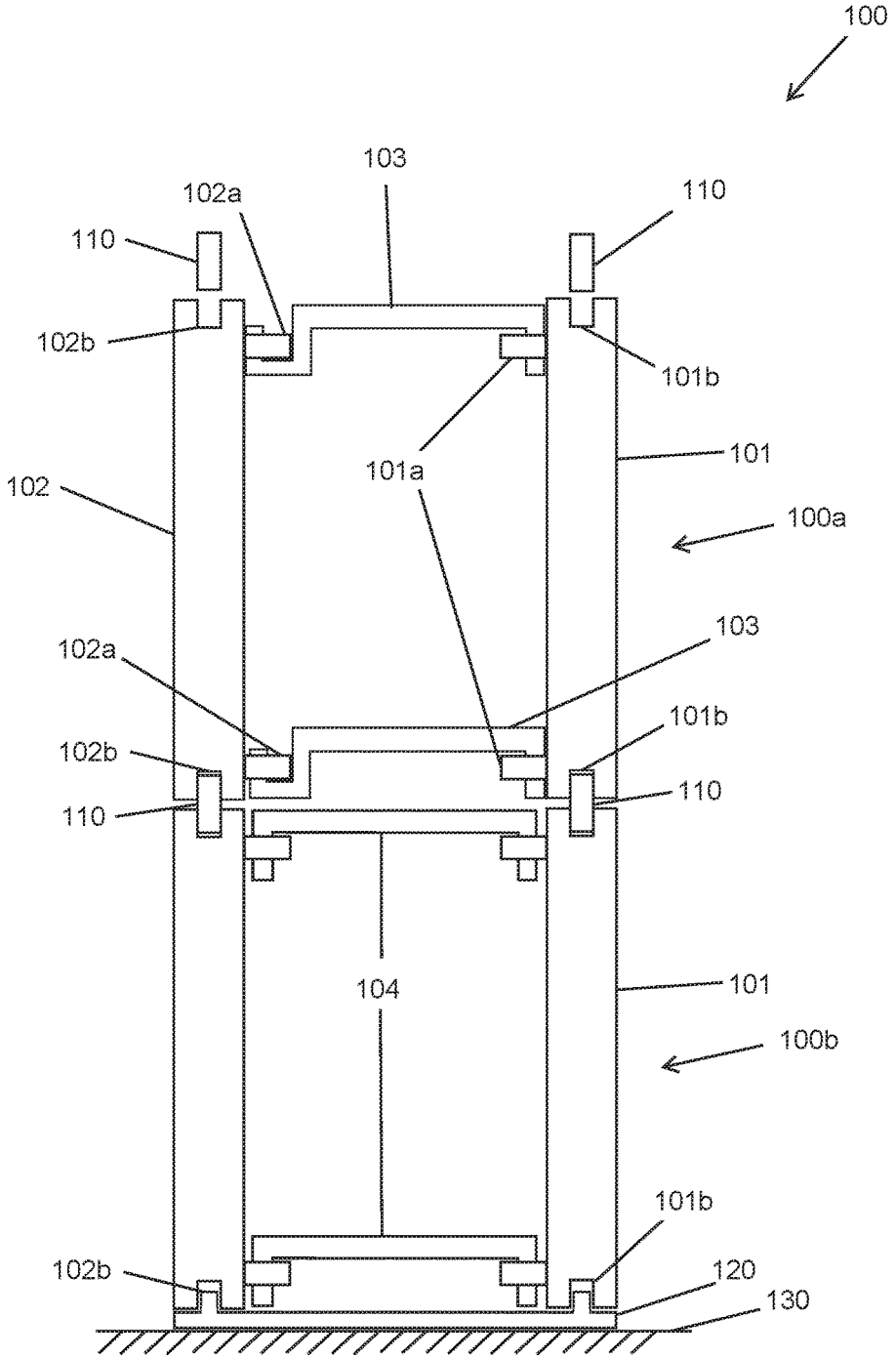
FIG. 1 schematically illustrate a section view of the proposed system, according to an embodiment of the present invention.

FIG. 1 schematically illustrate a section view of the proposed system, according to an embodiment of the present invention, in which system 100 comprises building units 100*a* and 100*b* (e.g., forming a mold for a small wall), where unit 100*a* of the proposed system is essentially constructed of two counter mold partitions 101 and 102 (e.g., two counter faces of a wall unit), each of which is adapted with anchoring means 101*a* and 102*a* correspondingly into which connecting locks 103 are engaged to firmly lock and stabilize the two counter mold partitions. Anchoring means 101*a* and 102*a* can either be add-on brackets added onto mold partitions 101 and 102, or embedded brackets of mold partitions 101 and 102. Of course, multiple different designs of connecting locks can be selected by a person skilled in the art, in accordance with specific preferences and requirements in various applications of the proposed system, such as connecting locks 104 of building unit 100*b*. For example, the use of connecting locks 103 is preferred when the placement of mold partition 102 is at a later timing, and hence, whereas mold partition 101 is already in place together with connecting locks 103, mold partition 101 is being threaded from above onto the "U" shaped edges of connecting locks 103.

Furthermore, mold partitions 101 and 102 comprises longitudinal grooves 101*b* and 102*b* correspondingly, into which coupling means such as rectangular profiles 110 are engaged for coupling residing building units (e.g., mold partitions 101 of building units 100*a* and 100*b*), or such as floor affixing unit 120 being anchored to the floor for affixing building unit 100*b* to a floor surface 130. The width and depth of profiles 110 are selected to be reduced with respect to grooves 101*b* and 102*b*, to allow application of suitable portion of adhesive and sealing materials. Of course, multiple different designs of profiles 110 may be selected by one skilled in the art according to specific desirable designs of building units 100*a* and 100*b* as well as its fitness to desirable internal elements (e.g., where a horizontal building unit is utilized for constructing a ceiling with downwardly protruding anchors for lighting fixtures).

Figure 8:
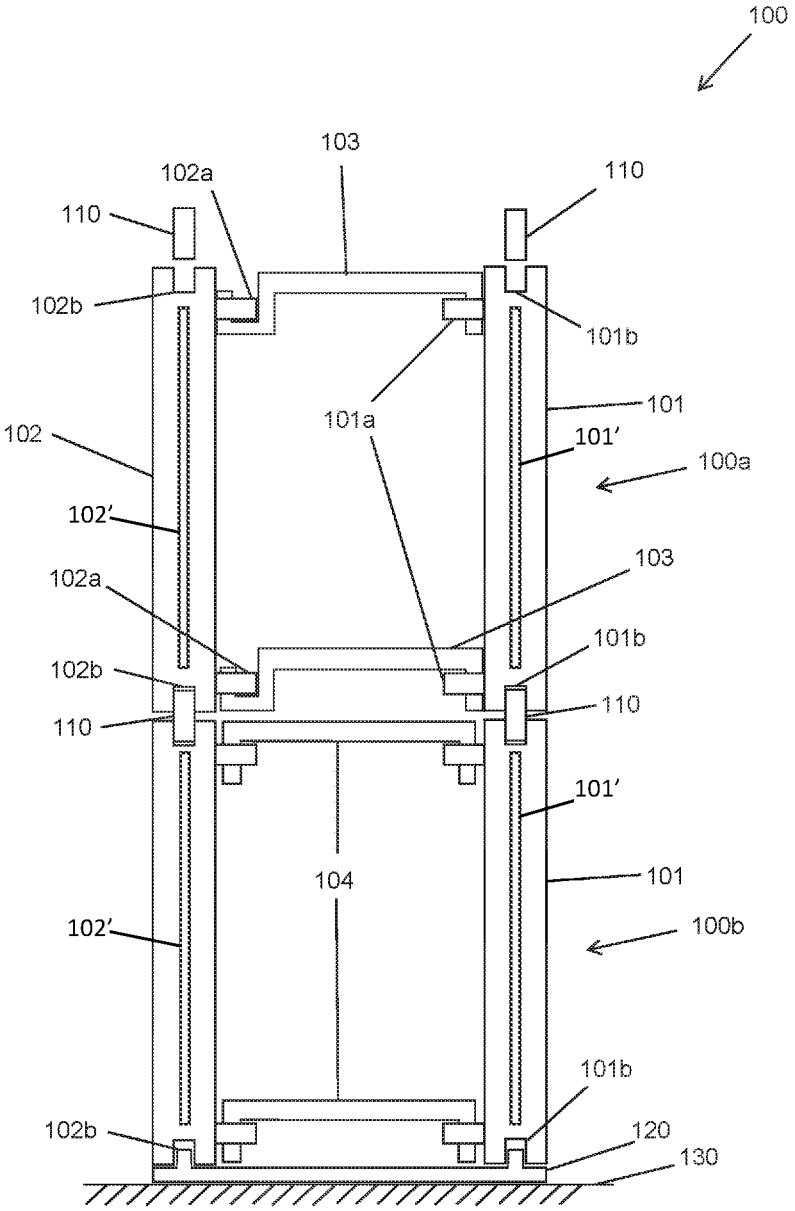
FIG. 8 illustrates an alternate embodiment of the embodiment illustrated in FIG. 1.

While mold partitions 101 and 102 of FIG. 1 are schematically illustrated as solid plates, they can also be multi-layered plates, for example, comprising thermal isolation layers 101' and 102', as illustrated in FIG. 8. Furthermore, according to different embodiments of the present invention, mold partitions 101 and 102 are of different thicknesses in accordance with expected loading. Moreover, the position of grooves 101 *b* and 102 *b* with respect to the sectional width of mold partitions 101 and 102 may vary with respect to decorative and structural preferences.

Figure 2:
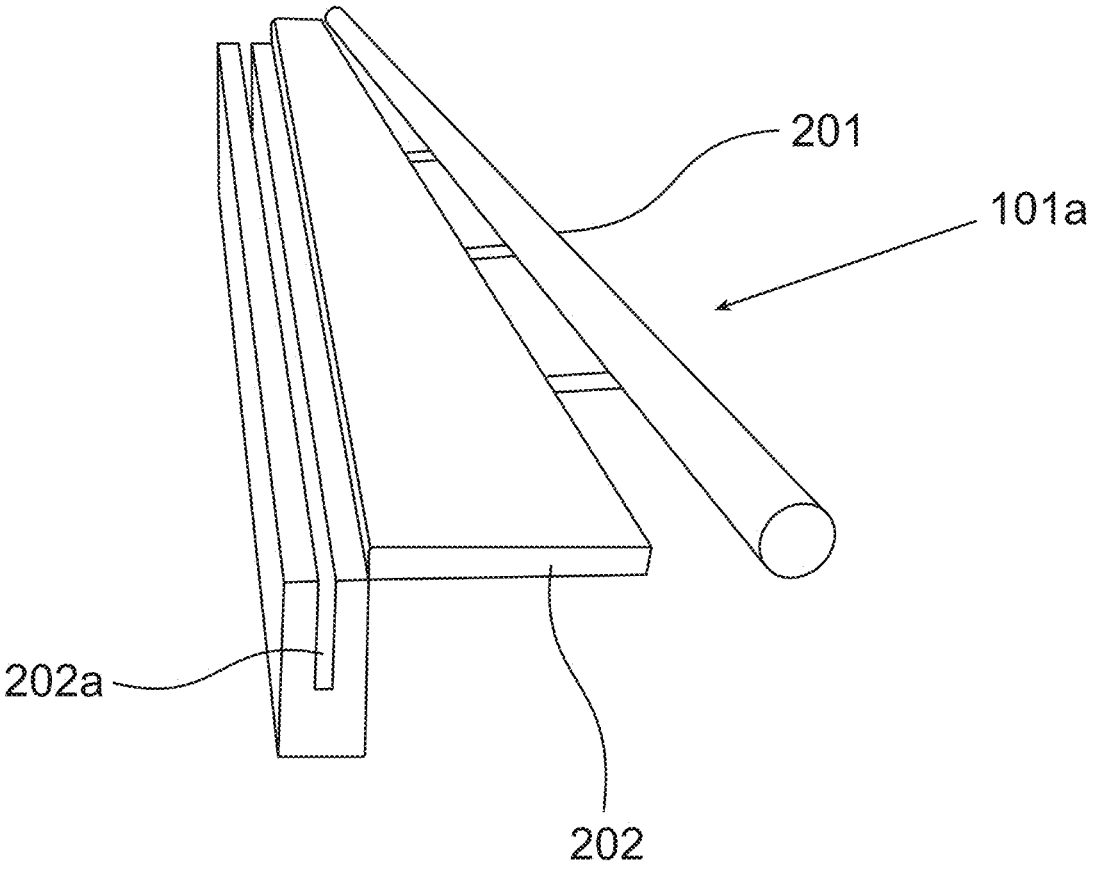
FIG. 2 shows another example of anchoring means 101*a*, according to an embodiment of the present invention.

FIG. 2 shows another example of anchoring means 101*a*, according to an embodiment of the present invention, in which anchoring means 101*a* is an elongated assembly of a round bar 201 attached (e.g., welded) to an elongated profile 202 having a formed portion 202*a* which is suitable for engagement and adhesion into grooves 101*b* of FIG. 1, where formed portion 202*a* is adapted to receive coupling means such as rectangular profiles 110 of FIG. 1.

Figure 3:
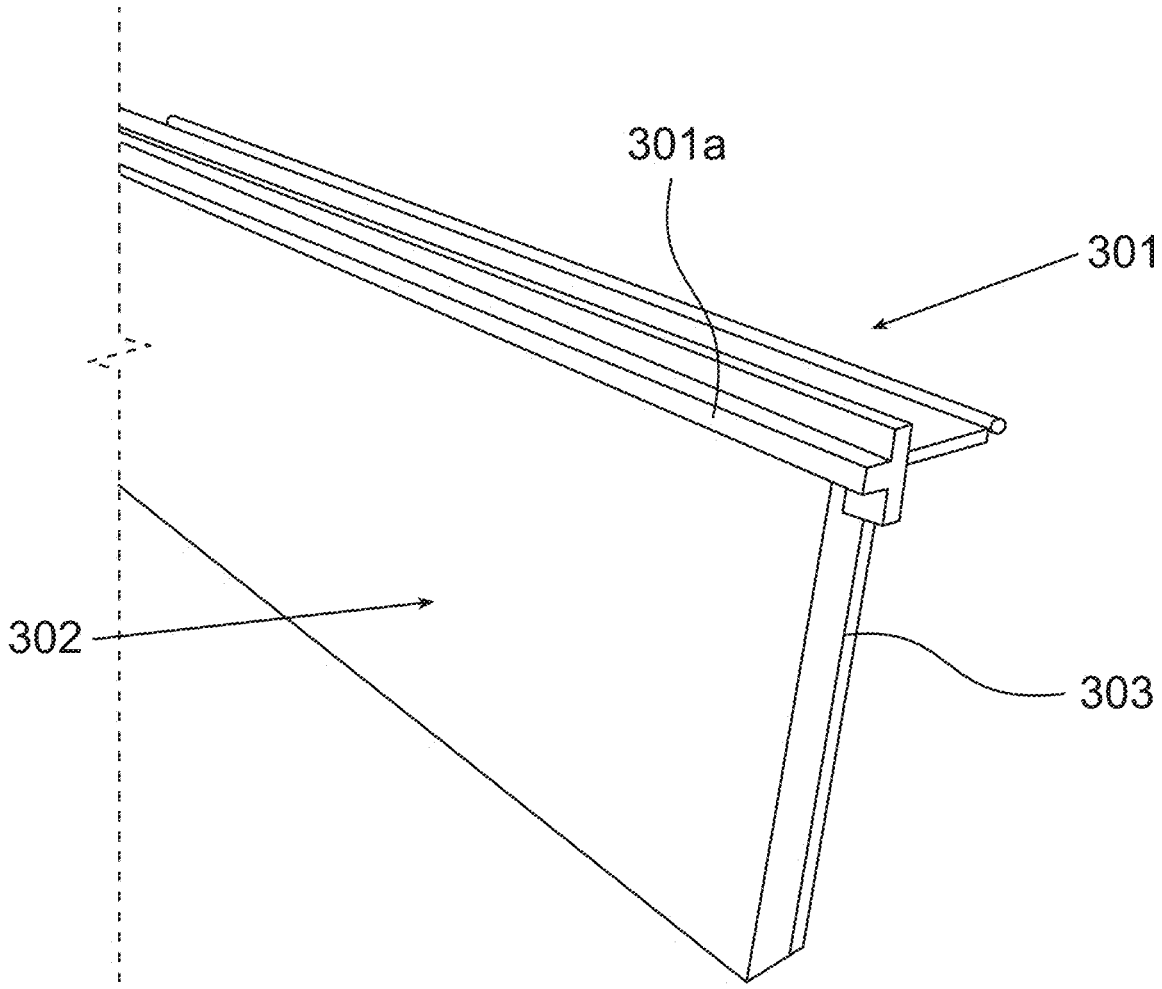
FIG. 3 shows an integrated anchoring and coupling means, according to an embodiment of the present invention.

FIG. 3 shows an integrated anchoring and coupling means, according to an embodiment of the present invention, in which a single anchoring and coupling profile 301 is integrated (e.g., adhered) into groove 101*b* (of FIG. 1) of a mold partition 302. Further show is a lateral coupling profile 303 which is engaged with mold partition 302 for coupling a laterally residing mold partition. Further shown in FIG. 3 is a decorative finishing portion 301*a* of profile 301 being highly useful for complementary decoration and sealing inbetween mold partitions 302 of external building surfaces.

Figure 4:
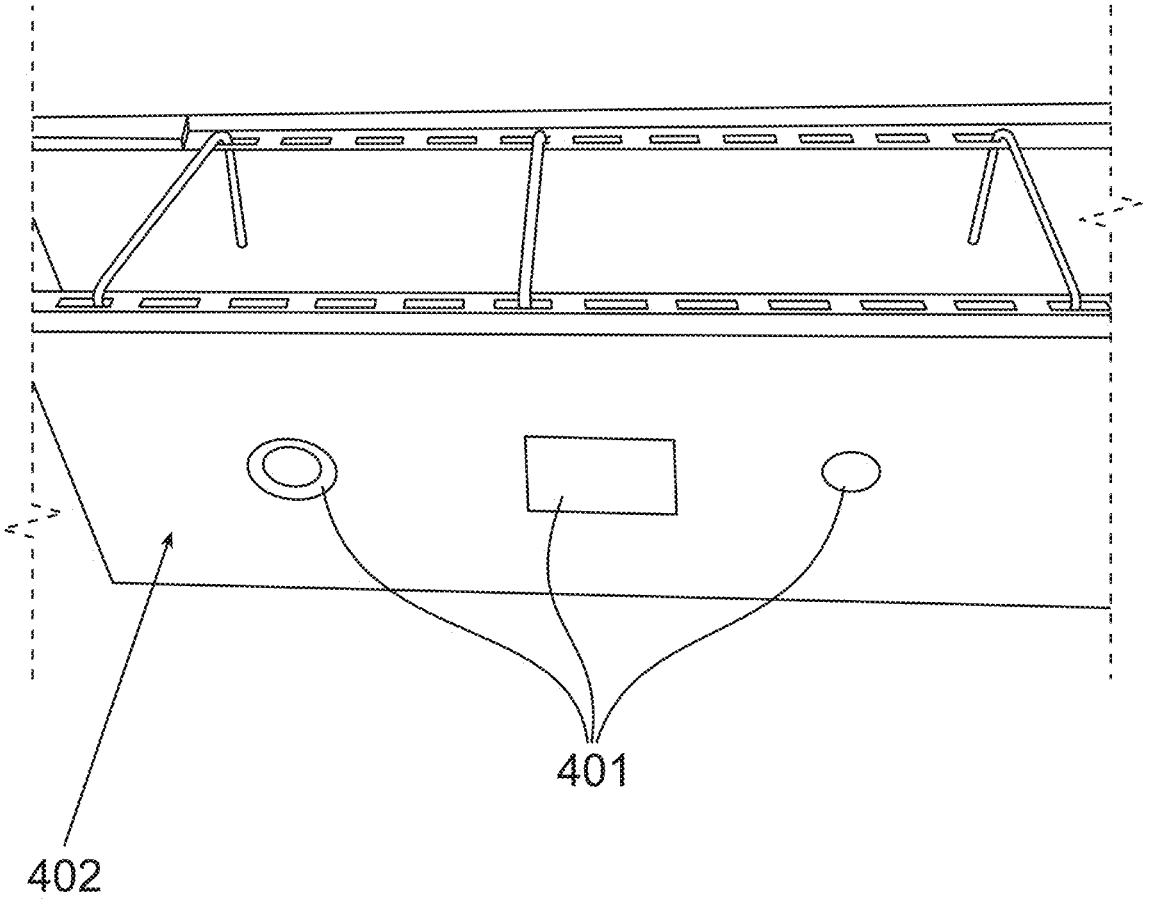
FIG. 4 shows an integrated of building utilities with the proposed system, according to an embodiment of the present invention.

FIG. 4 shows an integrated of building utilities with the proposed system, according to an embodiment of the present invention, in which various utility elements 401 such as water piping fittings, electrical junction boxes, or other conduit passages, are being integrated with an internal mold partition 402 (e.g., internal surface of a wall), thus enabling a convenient routing of utility piping and wiring.

Figure 5A:
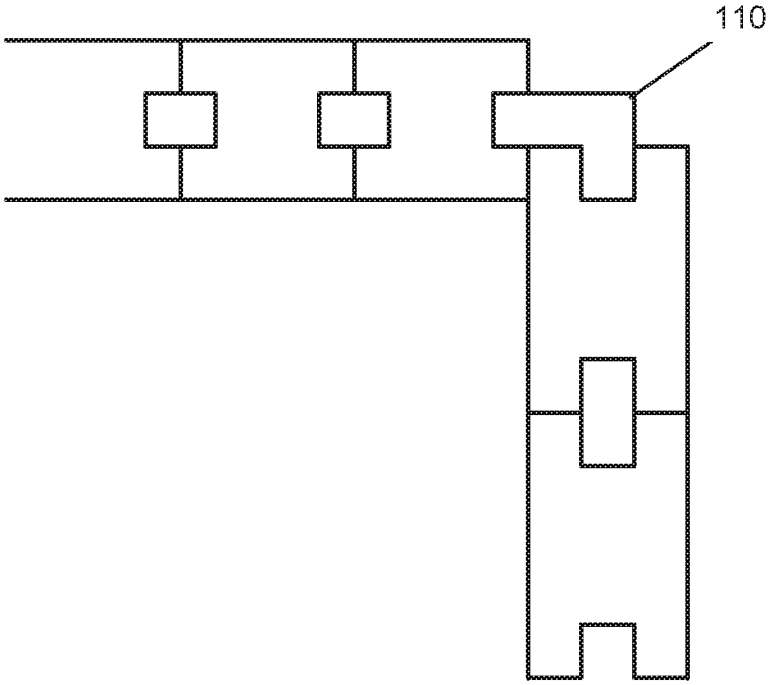
FIGS. 5A-5B schematically illustrate different designs of coupling profiles, according to an embodiment of the present invention.
Figure 5B:
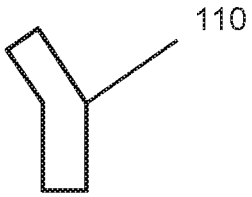
Figure 6:
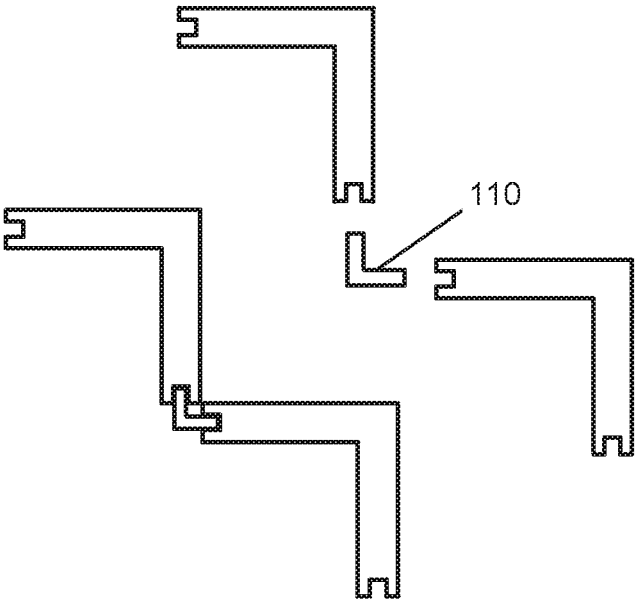
FIG. 6 schematically illustrate stairs, according to an embodiment of the present invention.

FIGS. 5A-5B schematically illustrate different designs of profiles 110, being used with the proposed system for creating corner building units, as well as stairs as shown in FIG. 6.

Figure 7:
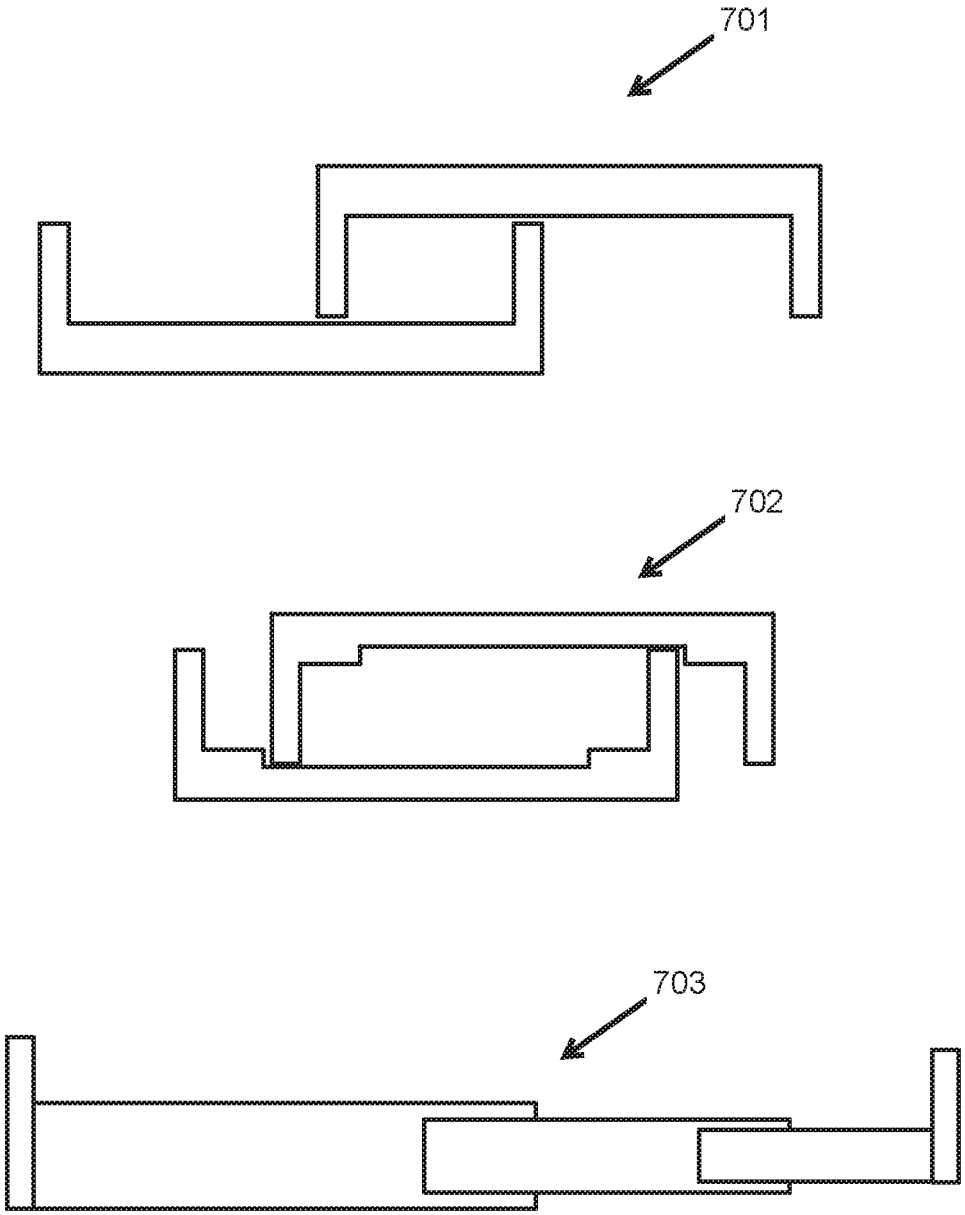
FIG. 7 schematically adjustable connecting locks, according to an embodiment of the present invention.

FIG. 7 schematically illustrates adjustable connecting locks 701, 702 (of a limited extension) and a telescopic 703, that may be used as an alternative to locks 103 and 104 of FIG. 1, where the use of locks 701-703 enables to perform last minute modifications (i.e., before casting), as well as constructing vertically or laterally inclined building units (e.g., variating depth of a wall).

The proposed structure system enables a highly efficient construction method, according to which an extended mold (i.e., which is stabilized and affixed to adjacent structure elements) is assembled, into which concrete (i.e., or other suitable solidifying material) is casted to form a complete structure element, which does not require pre assembly of wooden/metal mold plates and steel reinforcements, and does not require post-casting disassembly of the mold plates (i.e., mold partitions 101 and 102 are an integral element of building units 101*a* 101*b*), thereby enabling a relatively fast construction of structure elements.

Upon casting concrete into the mold formed between the two counter mold partitions, static pressure is applied to both partitions due to the weight of the casted concrete. The higher the partitions are, the higher is the pressure. This pressure between counter mold partitions applies opposing lateral forces on the partitions which causes the anchoring means to strongly pull the connecting locks to two opposing directions. These lateral forces has two positive effects. First, the structure is maximally stabilized since the locks are tensioned. Second, the casted concrete is solidified on tensioned metals (in this case, the locks) and thereby causes a similar reinforcement effect to the effect of Prestressed concrete. This strongly increases the of the resulting walls durability against socks, such as during earthquakes.

Moreover, utilizing the proposed system and method can reduce (i.e., and possibly eliminate in some cases) the need for scaffoldings, thus requiring fewer scaffoldings at the construction site, hence further reducing construction costs and duration.

According to one embodiment of the present invention, the solidifying substance is prepared from a mixture of at least two of the following materials:

White cement;
Black cement;
Sea sand;
Quartz sand;
Fiberglass fibres;
Fiberglass rods construction;

Power and fibres of basalt;
Mineral wool;
Sodium-Chloride power.

Although embodiments of the invention have been described by way of illustration, it will be understood that the invention may be carried out with many variations, modifications, and adaptations, without exceeding the scope of the claims.

The invention claimed is:

1. A modular structural system, comprising:

a) one or more building units having two counter mold partitions, each of which has one or more anchoring means including one or more elongated apertures into which one or more connecting locks are engaged to firmly lock and stabilize said two counter mold partitions;

b) a first set of two or more coupling means for affixing two of said one or more building units to each other, wherein each of said two counter mold partitions of each of said one or more building units is peripherally adapted to receive one or more coupling means of the first set; and c) a second set of two or more coupling means for affixing said one or more building units to an adjacent building element, wherein each of said two counter mold partitions of each of said one or more building units is peripherally adapted to receive one or more coupling means of the second set;

wherein the elongated apertures of the anchoring means each has a major axis along the length of the elongated aperture extending perpendicularly to the connecting lock engaged thereto and a minor axis extending parallelly to the connecting lock engaged thereto.

2. A system according to claim 1, in which each of the two or more mold partitions are selected from the group consisting of: a solid plate, a multilayered plate, or any combination thereof.

3. A system according to claim 2, in which the multilayered plate comprises a thermal isolation layer.

4. A system according to claim 1, in which the one or more anchoring means are added onto the two counter mold partitions.

5. A system according to claim 1, in which the one or more anchoring means are integrated within the two counter mold partitions.

6. A system according to claim 1, in which the one or more anchoring means is integrated with the two or more coupling means.

7. A system according to claim 1, in which utility elements are embedded within one or more of the two counter mold partitions.

8. A system according to claim 1, in which the one or more connecting locks are of an adjustable length.

9. A modular construction method, comprising:

a) providing one or more building units having two counter mold partitions, each of which has one or more anchoring means including one or more elongated apertures into which connecting locks are engaged to firmly lock and stabilize the two counter mold partitions;

b) affixing each two residing building units by a first set of two or more coupling means;

c) affixing building units to an adjacent building element by a second set of two or more coupling means; and d) casting a solidifying substance into said one or more building units;

wherein the elongated apertures of the anchoring means each has a major axis along the length of the elongated aperture extending perpendicularly to the connecting lock engaged thereto and a minor axis extending parallelly to the connecting lock engaged thereto.

10. A method according to claim 9, wherein utility elements are embedded within one or more of the two counter mold partitions before casting a solidifying substance into said one or more building units.

11. A method according to claim 9, wherein one or more adjustable connecting locks are provided to enable modifying the depth of the one or more building units before casting the solidifying substance into said one or more building units.

12. A method according to claim 9, wherein the solidifying substance is prepared from a mixture of at least two of the following materials:

White cement;
Black cement;
Sea sand;
Quartz sand;
Fiberglass fibres; Fiberglass rods construction;
Power and fibres of basalt;
Mineral wool;
Sodium-Chloride power.

13. A system according to claim 1, wherein at least one of the connecting locks has an "S" cross-section.

14. A system according to claim 1, wherein at least one of the connecting locks has an "C" cross-section.

15. A method according to claim 9, wherein at least one of the connecting locks has an "S" cross-section.

16. A method according to claim 9, wherein at least one of the connecting locks has an "C" cross-section.

* * * * *